US010663220B2

(12) United States Patent
Krishnamurthy et al.

(10) Patent No.: US 10,663,220 B2
(45) Date of Patent: May 26, 2020

(54) MULTIPLE PRESSURE MIXED REFRIGERANT COOLING PROCESS AND SYSTEM

(71) Applicant: Air Products and Chemicals, Inc., Allentown, PA (US)

(72) Inventors: Gowri Krishnamurthy, Sellersville, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 15/287,963

(22) Filed: Oct. 7, 2016

(65) Prior Publication Data

US 2018/0100694 A1 Apr. 12, 2018

(51) Int. Cl.
*F25J 1/02* (2006.01)
*F25J 1/00* (2006.01)

(52) U.S. Cl.
CPC ..... *F25J 1/0022* (2013.01); *F25J 1/0055* (2013.01); *F25J 1/0214* (2013.01); *F25J 1/0217* (2013.01); *F25J 1/0227* (2013.01); *F25J 1/0292* (2013.01); *F25J 1/0294* (2013.01); *F25J 2205/02* (2013.01); *F25J 2210/60* (2013.01); *F25J 2240/40* (2013.01); *F25J 2270/66* (2013.01)

(58) Field of Classification Search
CPC ..... F25J 1/0214; F25J 1/0217; F25J 1/0022; F25J 1/0227; F25J 1/0042; F25J 2205/90
See application file for complete search history.

(56) References Cited

U.S. PATENT DOCUMENTS

| | | | | |
|---|---|---|---|---|
| 4,545,795 | A | 10/1985 | Liu et al. | |
| 6,105,389 | A | 8/2000 | Paradowski et al. | |
| 6,269,655 | B1 * | 8/2001 | Roberts | F25J 1/0022 62/612 |
| 6,347,531 | B1 | 2/2002 | Roberts et al. | |
| 6,347,532 | B1 | 2/2002 | Agrawal et al. | |
| 2010/0223951 | A1 * | 9/2010 | Jager | F25J 1/0042 62/613 |

(Continued)

FOREIGN PATENT DOCUMENTS

| | | |
|---|---|---|
| EP | 1455152 A1 | 9/2004 |
| WO | 2009153427 | 12/2009 |

OTHER PUBLICATIONS

J. Seitter et al, "Prico-DMR: An Innovative Approach to Highly Efficient, Scalable, and Cost-Competitive LNG", LNG 18 Perth Australia, Apr. 11-15, 2016, pp. 1-13.

(Continued)

*Primary Examiner* — Brian M King
(74) *Attorney, Agent, or Firm* — Amy Carr-Trexler

(57) ABSTRACT

Systems and methods described for increasing capacity and efficiency of natural gas liquefaction processes having a mixed refrigerant precooling system with multiple pressure levels comprising cooling the compressed mixed refrigerant stream and separating the cooled compressed mixed refrigerant stream into a vapor and liquid portion. The liquid portion provides refrigeration duty to a first precooling heat exchanger. The vapor portion is further compressed, cooled, and condensed, and used to provide refrigeration duty to a second precooling heat exchanger. Optionally additional precooling heat exchangers, and/or phase separators may be used.

21 Claims, 5 Drawing Sheets

(56) References Cited

U.S. PATENT DOCUMENTS

| | | | | |
|---|---|---|---|---|
| 2011/0226008 | A1* | 9/2011 | Gushanas | F25J 1/0012 62/613 |
| 2012/0036888 | A1* | 2/2012 | Vandor | F25J 1/0022 62/613 |
| 2016/0061516 | A1 | 3/2016 | Seitter et al. | |

OTHER PUBLICATIONS

R. Denton, et al, "ExxonMobil Enhanced Mixed Refrigerant (EMR) Process for Next Generation LNG Projects", ExxonMobil Upstream Research Company, Houston, TX, pp. 1-9.
H. Paradowski, et al, "Liquefaction of Associated Gases", LNG 7 Jakarta, May 15-18, 1983, pp. 1-15.
P-Y. Martin, et al, "Liquefin: An Innovative Process to Reduce LNG Costs".
"Prico-DMR Technology, Efficiency with Dual Mixed Refrigerant", Black & Veatch.

* cited by examiner

MULTIPLE PRESSURE MIXED REFRIGERANT COOLING PROCESS AND SYSTEM

BACKGROUND OF THE INVENTION

A number of liquefaction systems for cooling, liquefying, and optionally sub-cooling natural gas are well known in the art, such as the single mixed refrigerant (SMR) cycle, the propane-precooled mixed refrigerant (C3MR) cycle, the dual mixed refrigerant (DMR) cycle, C3MR-Nitrogen hybrid (such as AP-X™) cycles, the nitrogen or methane expander cycle, and cascade cycles. Typically, in such systems, natural gas is cooled, liquefied, and optionally sub-cooled by indirect heat exchange with one or more refrigerants. A variety of refrigerants might be employed, such as mixed refrigerants, pure components, two-phase refrigerants, gas phase refrigerants, etc. Mixed refrigerants (MR), which are a mixture of nitrogen, methane, ethane/ethylene, propane, butanes, and pentanes, have been used in many base-load liquefied natural gas (LNG) plants. The composition of the MR stream is typically optimized based on the feed gas composition and operating conditions.

The refrigerant is circulated in a refrigerant circuit that includes one or more heat exchangers and a refrigerant compression system. The refrigerant circuit may be closed-loop or open-loop. Natural gas is cooled, liquefied, and/or sub-cooled by indirect heat exchange in one or more refrigerant circuits by indirect heat exchanger with the refrigerants in the heat exchangers.

The refrigerant compression system includes a compression sequence for compressing and cooling the circulating refrigerant, and a driver assembly to provide the power needed to drive the compressors. For precooled liquefaction systems, the quantity and type of drivers in the driver assembly and the compression sequence have an impact on the ratio of the power required for the precooling system and the liquefaction system. The refrigerant compression system is a critical component of the liquefaction system because the refrigerant needs to be compressed to high pressure and cooled prior to expansion in order to produce a cold low pressure refrigerant stream that provides the heat duty necessary to cool, liquefy, and optionally sub-cool the natural gas.

DMR processes involve two mixed refrigerant streams, the first for precooling the feed natural gas and the second for liquefying the precooled natural gas. The two mixed refrigerant streams pass through two refrigerant circuits, a precooling refrigerant circuit within a precooling system, and a liquefaction refrigerant circuit within a liquefaction system. In each refrigerant circuit, the refrigerant stream is vaporized while providing cooling duty required to cool and liquefy the natural gas feed stream. When a refrigerant stream is vaporized at a single pressure level, the system and process is referred to as "single pressure". When a refrigerant stream is vaporized at two or more pressure levels, the system and process is referred to as "multiple pressure". Referring to FIG. 1, a DMR process of the prior art is shown in cooling and liquefaction system 100. The DMR process described herein involves a single pressure liquefaction system and a multiple pressure precooling system with two pressure levels. However, any number of pressure levels may be present. A feed stream, which is preferably natural gas, is cleaned and dried by known methods in a pre-treatment section (not shown) to remove water, acid gases such as $CO_2$ and $H_2S$, and other contaminants such as mercury, resulting in a pre-treated feed stream 102. The pre-treated feed stream 102, which is essentially water free, is precooled in a precooling system 134 to produce a second precooled natural gas stream 106 and further cooled, liquefied, and/or sub-cooled in a main cryogenic heat exchanger (MCHE) 164 to produce an LNG stream 108. The LNG stream 108 is typically let down in pressure by passing it through a valve or a turbine (not shown) and is then sent to LNG storage tank (not shown). Any flash vapor produced during the pressure letdown and/or boil-off in the tank may be used as fuel in the plant, recycled to feed, and/or sent to flare.

The pre-treated feed stream 102 is cooled in a first precooling heat exchanger 160 to produce a first precooled natural gas stream 104. The first precooled natural gas stream 104 is cooled in a second precooling heat exchanger 162 to produce the second precooled natural gas stream 106. The second precooled natural gas stream 106 is liquefied and subsequently sub-cooled to produce the LNG stream 108 at a temperature between about −170 degrees Celsius and about −120 degrees Celsius, preferably between about −170 degrees Celsius and about −140 degrees Celsius. MCHE 164 shown in FIG. 1 is a coil wound heat exchanger with two tube bundles, a warm bundle 166 and a cold bundle 167. However, any number of bundles and any exchanger type may be utilized. Although FIG. 1 shows two precooling heat exchangers and two pressure levels in the precooling circuit, any number of precooling heat exchangers and pressure levels may be utilized. The precooling heat exchangers are shown to be coil wound heat exchangers in FIG. 1. However, they may be plate and fin heat exchangers, shell and tube heat exchangers, or any other heat exchangers suitable for precooling natural gas.

The term "essentially water free" means that any residual water in the pre-treated feed stream 102 is present at a sufficiently low concentration to prevent operational issues associated with water freeze-out in the downstream cooling and liquefaction process. In the embodiments described in herein, water concentration is preferably not more than 1.0 ppm and, more preferably between 0.1 ppm and 0.5 ppm.

The precooling refrigerant used in the DMR process is a mixed refrigerant (MR) referred to herein as warm mixed refrigerant (WMR) or "first refrigerant", comprising components such as nitrogen, methane, ethane/ethylene, propane, butanes, and other hydrocarbon components. As illustrated in FIG. 1, a low pressure WMR stream 110 is withdrawn from the warm end of the shell side of the second precooling heat exchanger 162 and compressed in a first compression stage 112A of a WMR compressor 112. A medium pressure WMR stream 118 is withdrawn from the warm end of the shell side of the first precooling heat exchanger 160 and introduced as a side-stream into the WMR compressor 112, where it mixes with the compressed stream (not shown) from the first compression stage 112A. The mixed stream (not shown) is compressed in a second WMR compression stage 112B of the WMR compressor 112 to produce a compressed WMR stream 114. Any liquid present in the low pressure WMR stream 110 and the medium pressure WMR stream 118 are removed in vapor-liquid separation devices (not shown).

The compressed WMR stream 114 is cooled and preferably condensed in WMR aftercooler 115 to produce a first cooled compressed WMR stream 116, which is introduced into the first precooling heat exchanger 160 to be further cooled in a tube circuit to produce a second cooled compressed WMR stream 120. The second cooled compressed WMR stream 120 is split into two portions; a first portion 122 and a second portion 124. The first portion of the second cooled compressed WMR stream 122 is expanded in a first WMR expansion device 126 to produce a first expanded WMR stream 128, which is introduced into the shell side of the first precooling heat exchanger 160 to provide refrigeration duty. The second portion of the second cooled compressed WMR stream 124 is introduced into the second precooling heat exchanger 162 to be further cooled, after which it is expanded in a second WMR expansion device 130 to produce a second expanded WMR stream 132, which is introduced into the shell side of the second precooling heat exchanger 162 to provide refrigeration duty. The process of compressing and cooling the WMR after it is withdrawn from the precooling heat exchangers is generally referred to herein as the WMR compression sequence.

Although FIG. 1 shows that compression stages 112A and 112B are performed within a single compressor body, they may be performed in two or more separate compressors. Further, intermediate cooling heat exchangers may be provided between the stages. The WMR compressor 112 may be any type of compressor such as centrifugal, axial, positive displacement, or any other compressor type.

In the DMR process, liquefaction and sub-cooling is performed by heat exchanging precooled natural gas against a second mixed refrigerant stream, referred to herein as cold mixed refrigerant (CMR) or "second refrigerant".

A warm low pressure CMR stream 140 is withdrawn from the warm end of the shell side of the MCHE 164, sent through a suction drum (not shown) to separate out any liquids and the vapor stream is compressed in CMR compressor 141 to produce a compressed CMR stream 142. The warm low pressure CMR stream 140 is typically withdrawn at a temperature at or near WMR precooling temperature and preferably less than about −30 degree Celsius and at a pressure of less than 10 bara (145 psia). The compressed CMR stream 142 is cooled in a CMR aftercooler 143 to produce a compressed cooled CMR stream 144. Additional phase separators, compressors, and aftercoolers may be present. The process of compressing and cooling the CMR after it is withdrawn from the warm end of the MCHE 164 is generally referred to herein as the CMR compression sequence.

The compressed cooled CMR stream 144 is then cooled against evaporating WMR in precooling system 134. The compressed cooled CMR stream 144 is cooled in the first precooling heat exchanger 160 to produce a first precooled CMR stream 146 and then, cooled in the second precooling heat exchanger 162 to produce a second precooled CMR stream 148, which may be fully condensed or two-phase depending on the precooling temperature and composition of the CMR stream. FIG. 1 shows an arrangement wherein the second precooled CMR stream 148 is two-phase and is sent to a CMR phase separator 150 to produce a CMR liquid (CMRL) stream 152 and a CMR vapor (CMRV) stream 151, which are both sent back to the MCHE 164 to be further cooled. Liquid streams leaving phase separators are referred to in the industry as MRL and vapor streams leaving phase separators are referred to in the industry as MRV, even after they are subsequently liquefied.

Both the CMRL stream 152 and CMRV stream 151 are cooled, in two separate circuits of the MCHE 164. The CMRL stream 152 is cooled and partially liquefied in a warm bundle 166 of the MCHE 164, resulting in a cold stream that is let down in pressure across CMRL expansion device 153 to produce an expanded CMRL stream 154, that is sent back to the shell side of MCHE 164 to provide refrigeration required in the warm bundle 166. The CMRV stream 151 is cooled in the warm bundle 166 and subsequently in a cold bundle 167 of MCHE 164, reduced in pressure across a CMRV expansion device 155 to produce an expanded CMRV stream 156 that is introduced to the MCHE 164 to provide refrigeration required in the cold bundle 167 and warm bundle 166.

MCHE 164 and precooling heat exchanger 160 can be any exchanger suitable for natural gas cooling and liquefaction such as a coil wound heat exchanger, plate and fin heat exchanger, or a shell and tube heat exchanger. Coil wound heat exchangers are the state of the art exchangers for natural gas liquefaction and include at least one tube bundle comprising a plurality of spiral wound tubes for flowing process and warm refrigerant streams and a shell space for flowing a cold refrigerant stream.

In the arrangement shown in FIG. 1, the cold end of the first precooling heat exchanger 160 is at a temperature below 20 degrees Celsius, preferably below about 10 degrees Celsius, and more preferably below about 0 degrees Celsius. The cold end of the second precooling heat exchanger 162 is at a temperature below 10 degrees Celsius, preferably below about 0 degrees Celsius, and more preferably below about −30 degrees Celsius. Therefore, the second precooling heat exchanger is at a lower temperature than the first precooling heat exchanger.

A key benefit of a mixed refrigerant cycle is that the composition of the mixed refrigerant stream can be optimized to adjust cooling curves in the heat exchanger, the outlet temperature, and therefore the process efficiency. This may be achieved by adjusting the composition of the refrigerant stream for the various stages of the cooling process. For instance, a mixed refrigerant with a high concentration of ethane and heavier components is well suited as a precooling refrigerant while one with a high concentration of methane and nitrogen is well suited as a subcooling refrigerant.

In the arrangement shown in FIG. 1, the composition of the first expanded WMR stream 128 providing refrigeration duty to the first precooling heat exchanger is the same as the composition of the second expanded WMR stream 132 providing refrigeration duty to the second precooling heat exchanger 162. Since the first and second precooling heat exchangers cool to different temperatures, using the same refrigerant composition for both exchangers is inefficient. Further, the inefficiency increases with three of more precooling heat exchangers.

The reduced efficiency leads to an increased power required to produce the same amount of LNG. The reduced efficiency further results in a warmer overall precooling temperature at a fixed amount of available precooling driver power. This shifts the refrigeration load from the precooling system to the liquefaction system, rendering the MCHE larger and increasing the liquefaction power load, which may be undesirable from a capital cost and operability standpoint.

One approach to solving this problem is to have two separate closed loop refrigerant circuits for each stage of precooling. This would imply having separate mixed refrigerant circuits for the first precooling heat exchanger 160 and the second precooling heat exchanger 162. This would allow the compositions of the two refrigerant streams to be optimized independently and therefore improve efficiency. However, this approach would require separate compression systems for each precooling heat exchanger, which would lead to increased capital cost, footprint, and operational complexity, which is undesirable.

The present invention is a high efficiency, low capital cost, operationally simple, low footprint, and flexible DMR process that solves the problems mentioned above and provides significant improvements over the prior art.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Some embodiments, as described below and defined by the claims which follow, comprise improvements to the precooling portion of an LNG liquefaction process. Some embodiments satisfy the need in the art by using multiple precooling heat exchange sections in the precooling portion and introducing a stream of the refrigerant used to provide refrigeration duty to the precooling heat exchange sections into a compression system at different pressures. Some embodiments satisfy the need in the art by directing a liquid fraction of a stream of the refrigerant that is intercooled and separated between compression stages of the compression system.

Several aspects of the systems and methods are outlined below.

Aspect 1: A method of cooling a hydrocarbon feed stream comprising a hydrocarbon fluid and a second refrigerant feed stream comprising a second refrigerant by indirect heat exchange with a first refrigerant in each of a plurality of heat exchange sections, wherein the method comprises:

(a) introducing the hydrocarbon feed stream and the second refrigerant feed stream into a warmest heat exchange section of the plurality of heat exchange sections;

(b) cooling the hydrocarbon feed stream and the second refrigerant feed stream in each of the plurality of heat exchange sections to produce a precooled hydrocarbon stream and a precooled second refrigerant stream;

(c) further cooling and liquefying the precooled hydrocarbon stream (206,306,406,506) in a main heat exchanger against the second refrigerant to produce a liquefied hydrocarbon stream;

(d) withdrawing a low pressure first refrigerant stream from a coldest heat exchange section of the plurality of heat exchange sections and compressing the low pressure first refrigerant stream in at least one compression stage of a compression system;

(e) withdrawing a medium pressure first refrigerant stream from a first heat exchange section of the plurality of heat exchange sections, the first heat exchange section being warmer than the coldest heat exchange section;

(f) combining the low pressure first refrigerant stream and the medium pressure first refrigerant stream to produce a combined first refrigerant stream after steps (d) and (e) have been performed;

(g) withdrawing from the compression system, a high-high pressure first refrigerant stream;

(h) cooling and at least partially condensing the high-high pressure first refrigerant stream in at least one cooling unit to produce a cooled high-high pressure first refrigerant stream;

(i) introducing the cooled high-high pressure first refrigerant stream into a first vapor-liquid separation device to produce a first vapor refrigerant stream and a first liquid refrigerant stream;

(j) introducing the first liquid refrigerant stream into the warmest heat exchange section of the plurality of heat exchange sections;

(k) cooling the first liquid refrigerant stream in the warmest heat exchange section of the plurality of heat exchange sections to produce a first cooled liquid refrigerant stream;

(l) expanding at least a portion of the first cooled liquid refrigerant stream to produce a first expanded refrigerant stream;

(m) introducing the first expanded refrigerant stream into the warmest heat exchange section to provide refrigeration duty to provide a first portion of the cooling of step (b);

(n) compressing at least a portion of the first vapor refrigerant stream of step (i) in at least one compression stage;

(o) cooling and condensing a compressed first refrigerant stream in at least one cooling unit to produce a condensed first refrigerant stream, the at least one cooling unit being downstream from and in fluid flow communication with the at least one compression stage of step (n);

(p) introducing the condensed first refrigerant stream into the warmest heat exchange section of the plurality of heat exchange sections;

(q) cooling the condensed first refrigerant stream in the first heat exchange section and the coldest heat exchange section to produce a first cooled condensed refrigerant stream;

(r) expanding the first cooled condensed refrigerant stream to produce a second expanded refrigerant stream; and (s) introducing the second expanded refrigerant stream into the coldest heat exchange section to provide refrigeration duty to provide a second portion of the cooling of step (b).

Aspect 2: The method of Aspect 1, wherein step (e) further comprises withdrawing the medium pressure first refrigerant stream from the first heat exchange section of the plurality of heat exchange sections, the first heat exchange section being warmer than the coldest heat exchange section, wherein the first heat exchange section is also the warmest heat exchange section.

Aspect 3: The method of any of Aspects 1 through 2, wherein step (n) further comprises compressing the first vapor refrigerant stream of step (i) in at least one compression stage to form the compressed first refrigerant stream of step (o).

Aspect 4: The method of any of Aspects 1 through 3, further comprising compressing the combined first refrigerant stream of step (f) in at least one compression stage of the compression system prior to performing step (g).

Aspect 5: The method of any of Aspects 1 through 4, wherein step (e) further comprises withdrawing the medium pressure first refrigerant stream from a first heat exchange section of the plurality of heat exchange sections and compressing the medium pressure first refrigerant stream in at least one compression stage of the compression system, the first heat exchange section being warmer than the coldest heat exchange section.

Aspect 6: The method of any of Aspects 1 through 5, further comprising:

(t) withdrawing a first intermediate refrigerant stream from the compression system prior to step (g); and (u) cooling the first intermediate refrigerant stream in at least one cooling unit to produce a cooled first intermediate refrigerant stream and introducing the cooled first intermediate refrigerant stream into the compression system prior to step (g).

Aspect 7: The method of any of Aspects 1 through 6, further comprising:

(t) withdrawing a high pressure first refrigerant stream from the warmest heat exchange section of the plurality of heat exchange sections; and (u) introducing the high pressure first refrigerant stream into the compression system prior to step (g).

Aspect 8: The method of Aspect 7, further comprising:

(v) withdrawing a high pressure first refrigerant stream from the warmest heat exchange section of the plurality of heat exchange sections; and (w) combining the high pressure first refrigerant stream with the cooled first intermediate refrigerant stream to form a combined first intermediate refrigerant stream, and introducing the combined first intermediate refrigerant stream into the compression system prior to step (g).

Aspect 9: The method of any of Aspects 1 through 8, wherein step (n) further comprises:

(t) withdrawing a second intermediate refrigerant stream from the compression system; and (u) cooling the second intermediate refrigerant stream in at least one cooling unit to produce a cooled second intermediate refrigerant stream.

Aspect 10: The method of Aspect 9, further comprising:

(v) introducing the cooled second intermediate refrigerant stream into a second vapor-liquid separation device to produce a second vapor refrigerant stream and a second liquid refrigerant stream.

(w) introducing the second liquid refrigerant stream into the warmest heat exchange section of the plurality of heat exchange sections; and (x) compressing the second vapor refrigerant stream in at least one compression stage of the compression system prior to producing the compressed first refrigerant stream of stream (o).

Aspect 11: The method of any of Aspects 1 through 10 wherein step (q) further comprises cooling the condensed first refrigerant stream in the warmest heat exchange section prior to cooling in the first heat exchange section.

Aspect 12: The method of any of Aspects 1 through 11 wherein the low pressure first refrigerant stream of step (d), the combined first refrigerant stream of step (f), and the first vapor refrigerant stream of step (i) are compressed in multiple compression stages of a single compressor.

Aspect 13: The method of any of Aspects 1 through 12, wherein the first liquid refrigerant stream has a first composition consisting of less than 50% of ethane and lighter components.

Aspect 14: The method of any of Aspects 1 through 13, wherein the first vapor refrigerant stream has a second composition consisting of more than 40% components lighter than ethane.

Aspect 15: An apparatus for cooling a hydrocarbon feed stream comprising:

a plurality of heat exchange sections, the plurality of heat exchange sections comprising a warmest heat exchange section and a coldest heat exchange section;

a first hydrocarbon circuit that extends through each of the plurality of heat exchange sections, the first hydrocarbon circuit being downstream from and in fluid flow communication with a supply of a hydrocarbon fluid;

a second refrigerant circuit that extends through each of the plurality of heat exchange sections, the second refrigerant circuit containing a second refrigerant;

a first precooling refrigerant circuit that extends through the warmest heat exchange section, the first precooling refrigerant circuit containing a first refrigerant;

a second precooling refrigerant circuit that extends through the warmest heat exchange section and the coldest heat exchange section, the second precooling refrigerant circuit containing the first refrigerant;

a first precooling refrigerant circuit inlet located at an upstream end of the first precooling refrigerant circuit, a first pressure letdown device located at a downstream end of the first precooling refrigerant circuit, and a first expanded refrigerant conduit downstream from and in fluid flow communication with the first pressure letdown device and a first cold circuit of the warmest heat exchange section;

a second precooling refrigerant circuit inlet located at an upstream end of the second precooling refrigerant circuit, a second pressure letdown device located at a downstream end of the second precooling refrigerant circuit, and a second expanded refrigerant conduit downstream from and in fluid flow communication with the second pressure letdown device and a second cold circuit of the coldest heat exchange section;

a compression system comprising:

a low pressure first refrigerant conduit in fluid flow communication with a first compression stage and a warm end of the coldest heat exchange section;

a medium pressure first refrigerant conduit in fluid flow communication with a second compression stage and a warm end of a first heat exchange section;

a first aftercooler downstream from the second compression stage;

a first vapor-liquid separation device having a first inlet in fluid flow communication with, and downstream from, the first aftercooler, a first vapor outlet located in an upper half of the first vapor-liquid separation device, a first liquid outlet located in a lower half of the first vapor-liquid separation device, the first liquid outlet being upstream from and in fluid flow communication with the first precooling refrigerant circuit inlet;

a third compression stage downstream from the first vapor outlet; and a second aftercooler downstream from the third compression stage;

wherein the warmest heat exchange section is operationally configured to partially precool the hydrocarbon fluid flowing through the first hydrocarbon circuit, the second refrigerant flowing through the second refrigerant circuit, the first refrigerant flowing through the first precooling first refrigerant circuit, and the second precooling refrigerant circuit against the first refrigerant flowing through the first cold circuit of the warmest heat exchange section; and wherein the coldest heat exchange section is operationally configured to precool the hydrocarbon fluid flowing through the first hydrocarbon circuit to produce a precooled hydrocarbon stream, to precool the second refrigerant flowing through the second refrigerant circuit, and to pre-cool the first refrigerant flowing through the second precooling refrigerant circuit against the first refrigerant flowing through the first cold circuit of the coldest heat exchange section.

Aspect 16: The apparatus of Aspect 15, wherein the first heat exchange section is the warmest heat exchange section of the plurality of heat exchange sections.

Aspect 17: The apparatus of any of Aspects 15 through 16, wherein the first compression stage, the second compression stage, and the third compression stage are located with a single casing of a first compressor.

Aspect 18: The apparatus of any of Aspects 15 through 17, further comprising:

a main heat exchanger having a second hydrocarbon circuit that is downstream from and in fluid flow communication with the first hydrocarbon circuit of the plurality of heat exchange sections, the main heat exchanger being operationally configured to at least partially liquefy the pre-cooled hydrocarbon stream by indirect heat exchange against the second refrigerant.

Aspect 19: The apparatus of any of Aspects 15 through 18, the compression system further comprising a first intercooler downstream from the second compression stage and a cooled first intermediate refrigerant conduit downstream from and in fluid flow communication with the first intercooler.

Aspect 20: The apparatus of Aspect 19, further comprising a high pressure first refrigerant conduit in fluid flow communication with a warm end of the warmest heat exchange section and the cooled first intermediate refrigerant conduit.

Aspect 21: The apparatus of Aspect 20 further comprising:

a third aftercooler downstream from the first vapor-liquid separation device; and a second vapor-liquid separation device having a third inlet in fluid flow communication with and downstream from the third aftercooler, a second vapor outlet located in an upper half of the second vapor-liquid separation device, a second liquid outlet located in a lower half of the second vapor-liquid separation device.

Aspect 22: The apparatus of any of Aspects 15 through 21, wherein the plurality of heat exchange sections are multiple sections of a first heat exchanger.

Aspect 23: The apparatus of any of Aspects 15 through 22, wherein the plurality of heat exchange sections each comprises a coil wound heat exchanger.

Aspect 24: The apparatus of any of Aspects 15 through 23, wherein the main heat exchanger is a coil wound heat exchanger.

Aspect 25: The apparatus of any of Aspects 15 through 24, wherein the second precooling refrigerant circuit extends through the warmest heat exchange section, the first heat exchange section, and the coldest heat exchange section.

Aspect 26: The apparatus of any of Aspects 15 through 25, wherein the first refrigerant contained in the second precooling refrigerant circuit has a higher concentration of ethane and lighter hydrocarbons than the first refrigerant contained in the first precooling refrigerant circuit.

Aspect 27: The apparatus of any of Aspects 15 through 26, wherein the first cold circuit of the warmest heat section is a shell-side of the warmest heat exchange section and the first cold circuit of the coldest heat exchange section is a shell-side of the coldest heat exchange section.

Aspect 28: The apparatus of any of Aspects 15 through 27, further comprising a third precooling refrigerant circuit that extends through at least the warmest heat exchange section and the first heat exchange section, the third precooling refrigerant circuit containing the first refrigerant.

DETAILED DESCRIPTION OF THE INVENTION

Figure 1:
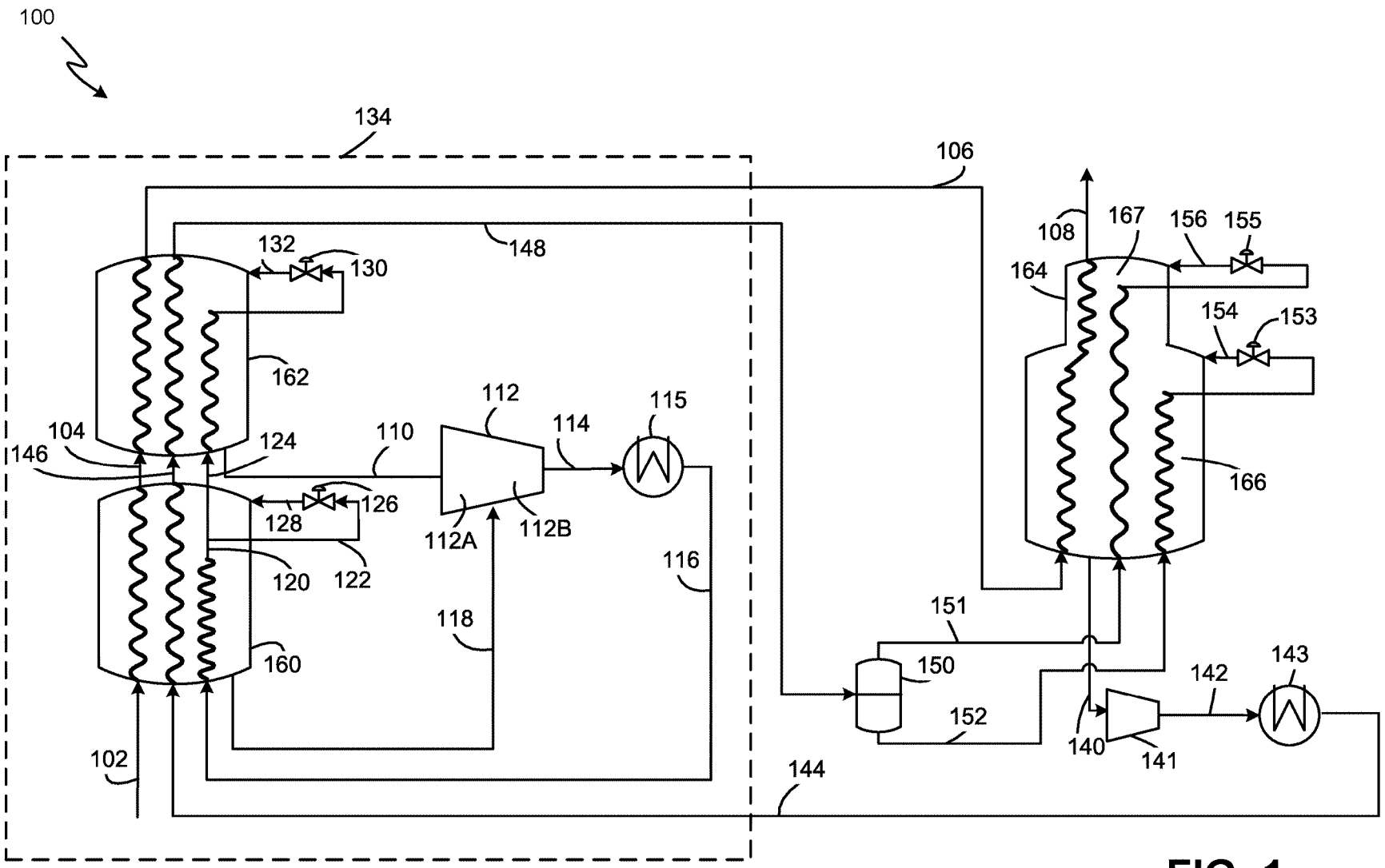
FIG. 1 (PRIOR ART)
FIG. 1 is a schematic flow diagram of a DMR system in accordance with the prior art.

The ensuing detailed description provides preferred exemplary embodiments only, and is not intended to limit the scope, applicability, or configuration thereof. Rather, the ensuing detailed description of the preferred exemplary embodiments will provide those skilled in the art with an enabling description for implementing the preferred exemplary embodiments. Various changes may be made in the function and arrangement of elements without departing from the spirit and scope thereof.

Reference numerals that are introduced in the specification in association with a drawing figure may be repeated in one or more subsequent figures without additional description in the specification in order to provide context for other features.

The term "fluid," as used in the specification and claims, refers to a gas and/or liquid.

The term "fluid flow communication," as used in the specification and claims, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

The term "natural gas", as used in the specification and claims, means a hydrocarbon gas mixture consisting primarily of methane.

The terms "hydrocarbon gas" or "hydrocarbon fluid", as used in the specification and claims, means a gas or fluid comprising at least one hydrocarbon and for which hydrocarbons comprise at least 80%, and more preferably at least 90% of the overall composition of the gas or fluid.

The term "mixed refrigerant" (abbreviated as "MR"), as used in the specification and claims, means a fluid comprising at least two hydrocarbons and for which hydrocarbons comprise at least 80% of the overall composition of the refrigerant.

The term "heavy mixed refrigerant", as used in the specification and claims, means an MR in which hydrocarbons at least as heavy as ethane comprise at least 80% of the overall composition of the MR. Preferably, hydrocarbons at least as heavy as butane comprise at least 10% of the overall composition of the mixed refrigerant.

The terms "bundle" and "tube bundle" are used interchangeably within this application and are intended to be synonymous.

The term "ambient fluid", as used in the specification and claims, means a fluid that is provided to the system at or near ambient pressure and temperature.

In the claims, letters are used to identify claimed steps (e.g. (a), (b), and (c)). These letters are used to aid in referring to the method steps and are not intended to indicate the order in which claimed steps are performed, unless and only to the extent that such order is specifically recited in the claims.

Directional terms may be used in the specification and claims (e.g., upper, lower, left, right, etc.). These directional terms are merely intended to assist in describing exemplary embodiments, and are not intended to limit the scope thereof. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

As used in the specification and claims, the terms "high-high", "high", "medium", "low", and "low-low" are intended to express relative values for a property of the elements with which these terms are used. For example, a high-high pressure stream is intended to indicate a stream having a higher pressure than the corresponding high pressure stream or medium pressure stream or low pressure stream described or claimed in this application. Similarly, a high pressure stream is intended to indicate a stream having a higher pressure than the corresponding medium pressure stream or low pressure stream described in the specification or claims, but lower than the corresponding high-high pressure stream described or claimed in this application. Similarly, a medium pressure stream is intended to indicate a stream having a higher pressure than the corresponding low pressure stream described in the specification or claims, but lower than the corresponding high pressure stream described or claimed in this application.

Unless otherwise stated herein, any and all percentages identified in the specification, drawings and claims should be understood to be on a weight percentage basis. Unless otherwise stated herein, any and all pressures identified in the specification, drawings and claims should be understood to mean gauge pressure.

As used herein, the term "cryogen" or "cryogenic fluid" is intended to mean a liquid, gas, or mixed phase fluid having a temperature less than −70 degrees Celsius. Examples of cryogens include liquid nitrogen (LIN), liquefied natural gas (LNG), liquid helium, liquid carbon dioxide and pressurized, mixed phase cryogens (e.g., a mixture of LIN and gaseous nitrogen). As used herein, the term "cryogenic temperature" is intended to mean a temperature below −70 degrees Celsius.

As used in the specification and claims, the term "heat exchange section" is defined as having a warm end and a cold end; wherein a separate cold refrigerant stream (other than ambient) is introduced at the cold end of the heat exchange section and a warm first refrigerant stream is withdrawn from the warm end of the heat exchange section. Multiple heat exchange sections may optionally be contained within a single or multiple heat exchangers. In case of a shell and tube heat exchanger or a coil wound heat exchanger, the multiple heat exchange sections may be contained within a single shell.

As used in the specification and claims, the "temperature" of a heat exchange section is defined by the outlet temperature of the hydrocarbon stream from that heat exchange section. For example, the terms "warmest", "warmer", "coldest", and "colder" when used with respect to a heat exchange section represent the outlet temperature of the hydrocarbon stream from that heat exchange section relative to the outlet temperatures of the hydrocarbon stream of other heat exchange sections. For example, a warmest heat exchange section is intended to indicate a heat exchange section having a hydrocarbon stream outlet temperature warmer than the hydrocarbon stream outlet temperature in any other heat exchange sections.

As used in the specification and claims, the term "compression system" is defined as one or more compression stages. For example, a compression system may comprise multiple compression stages within a single compressor. In an alternative example, a compression system may comprise multiple compressors.

Unless otherwise state herein, introducing a stream at a location is intended to mean introducing substantially all of the said stream at the location. All streams discussed in the specification and shown in the drawings (typically represented by a line with an arrow showing the overall direction of fluid flow during normal operation) should be understood to be contained within a corresponding conduit. Each conduit should be understood to have at least one inlet and at least one outlet. Further, each piece of equipment should be understood to have at least one inlet and at least one outlet.

Table 1 defines a list of acronyms employed throughout the specification and drawings as an aid to understanding the described embodiments.

TABLE 1

| | | | |
|---|---|---|---|
| SMR | Single Mixed Refrigerant | MR | Mixed Refrigerant |
| DMR | Dual Mixed Refrigerant | CMR | Cold Mixed Refrigerant |
| C3MR | Propane-precooled Mixed Refrigerant | WMR | Warm Mixed Refrigerant |
| LNG | Liquid Natural Gas | MRL | Mixed Refrigerant Liquid |
| MCHE | Main Cryogenic Heat Exchanger | MRV | Mixed Refrigerant Vapor |

Figure 2:
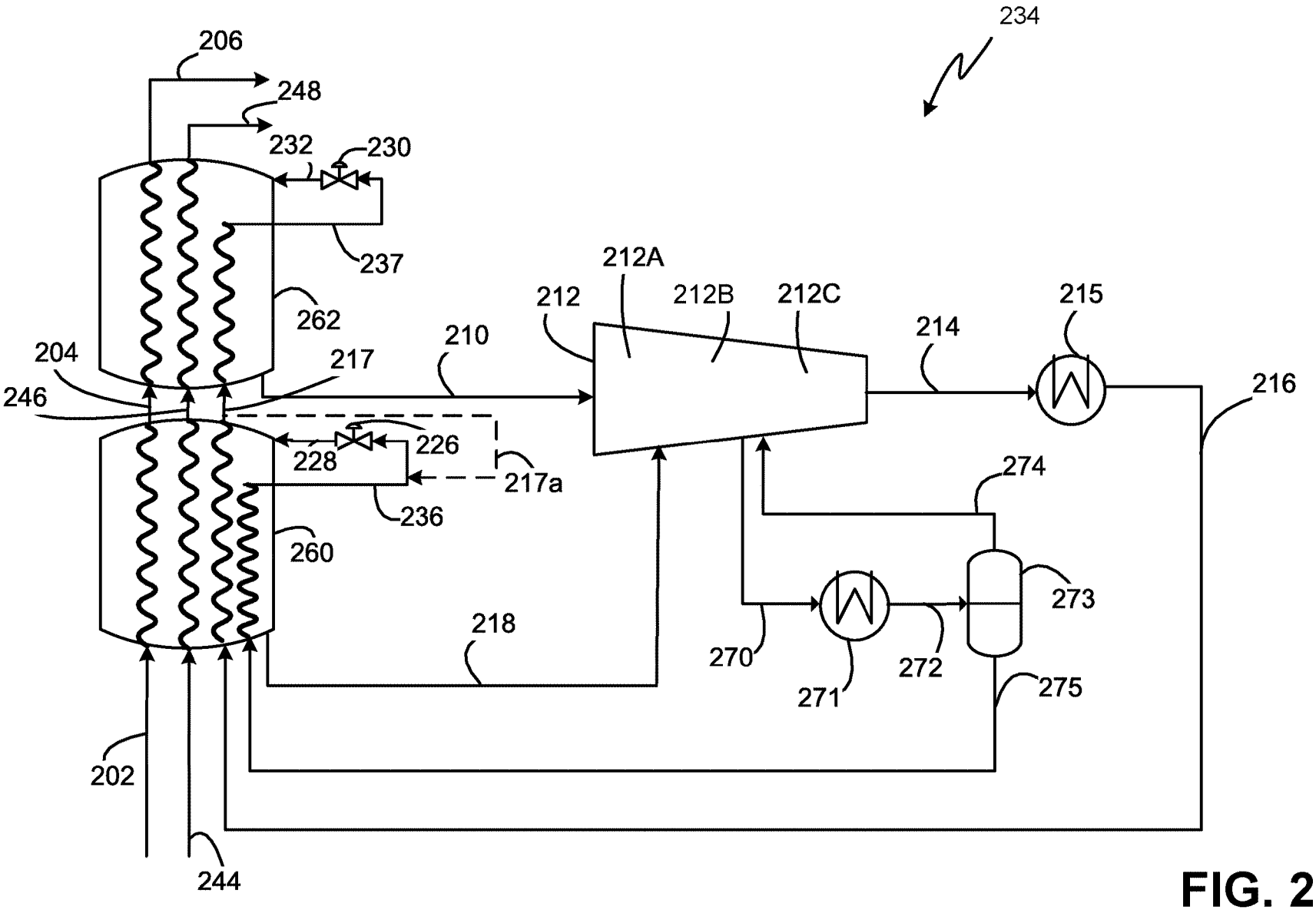
FIG. 2 is a schematic flow diagram of a precooling system of a DMR system in accordance with a first exemplary embodiment.

FIG. 2 shows a first embodiment. For simplicity, only the precooling system 234 is shown in FIG. 2 and subsequent figures. A low pressure WMR stream 210 is withdrawn from the warm end of the shell side of a second precooling heat exchanger 262 and compressed in a first compression stage 212A of a WMR compressor 212. A medium pressure WMR stream 218 is withdrawn from the warm end of the shell side of a first precooling heat exchanger 260 and introduced as a side-stream into the WMR compressor 212, where it mixes with compressed stream (not shown) from the first compression stage 212A. The mixed stream (not shown) is compressed in a second WMR compression stage 212B of the WMR compressor 212 to produce a high-high pressure WMR stream 270. Any liquid present in the low pressure WMR stream 210 and the medium pressure WMR stream 218 are removed in vapor-liquid separation devices (not shown) prior to introduction in the WMR compressor 212.

The high-high pressure WMR stream 270 may be at a pressure between 5 bara and 40 bara, and preferably between 15 bara and 30 bara. The high-high pressure WMR stream 270 is withdrawn from the WMR compressor 212, and cooled and partially condensed in a high-high pressure WMR intercooler 271 to produce a cooled high-high pressure WMR stream 272. The high-high pressure WMR intercooler 271 may be any suitable type of cooling unit, such as an ambient cooler that uses air or water, and may comprise one or more heat exchangers. The cooled high-high pressure WMR stream 272 may have a vapor fraction between 0.2 and 0.8, preferably between 0.3 and 0.7, and more preferably between 0.4 and 0.6. The cooled high-high pressure WMR stream 272 is phase separated in a first WMR vapor-liquid separation device 273 to produce a first WMRV stream 274 and a first WMRL stream 275.

The first WMRL stream 275 contains less than 50% of ethane and lighter hydrocarbons, preferably less than 45% of ethane and lighter hydrocarbons, and more preferably less than 40% of ethane and lighter hydrocarbons. The first WMRV stream 274 contains more than 40% of ethane and lighter hydrocarbons, preferably more than 45% of ethane and lighter hydrocarbons, and more preferably more than 50% of ethane and lighter hydrocarbons. The first WMRL stream 275 is introduced into the first precooling heat exchanger 260 to be cooled in a tube circuit to produce a first further cooled WMR stream 236 (also referred to as a cooled liquid refrigerant stream) that is expanded in a first WMR expansion device 226 (also referred to as a pressure letdown device) to produce a first expanded WMR stream 228 that provides refrigeration duty to the first precooling heat exchanger 260. Examples of suitable expansion devices include a Joule-Thomson (J-T) valve and a turbine.

The first WMRV stream 274 is introduced into the WMR compressor 212 to be compressed in a third WMR compression stage 212C of WMR compressor 212 to produce a compressed WMR stream 214. The compressed WMR stream 214 is cooled and preferably condensed in a WMR aftercooler 215 to produce a first cooled compressed WMR stream 216 (also referred to as a compressed first refrigerant stream), which is introduced into the first precooling heat exchanger 260 to be further cooled in a tube circuit to produce a first precooled WMR stream 217. The first precooled WMR stream 217 is introduced into the second precooling heat exchanger 262 to be further cooled in a tube circuit to produce a second further cooled WMR stream 237. The second further cooled WMR stream 237 is expanded in a second WMR expansion device 230 (also referred to as a pressure letdown device) to produce a second expanded WMR stream 232, which is introduced into the shell side of the second precooling heat exchanger 262 to provide refrigeration duty.

The first cooled compressed WMR stream 216 may be fully condensed or partially condensed. In a preferred embodiment, the first cooled compressed WMR stream 216 is fully condensed. The cooled high-high pressure WMR stream 272 may comprise less than 10% of components lighter than ethane, preferably less than 5% of components lighter than ethane, and more preferably less than 2% of components lighter than ethane. The light components accumulate in the first WMRV stream 274, which may comprise less than 20% of components lighter than ethane, preferably less than 15% of components lighter than ethane, and more preferably less than 10% of components lighter than ethane. Therefore, it is possible to fully condense the compressed WMR stream 214 to produce a totally condensed first cooled compressed WMR stream 216 without needing to compress to very high pressure. The compressed WMR stream 214 may be at a pressure between 300 psia (21 bara) and 600 psia (41 bara), and preferably between 400 psia (28 bara) and 500 psia (35 bara). If the second precooling heat exchanger 262 was a liquefaction heat exchanger used to fully liquefy the natural gas, the cooled high-high pressure WMR stream 272 would have a higher concentration of nitrogen and methane and therefore the pressure of the compressed WMR stream 214 would have to be higher in order for the first cooled compressed WMR stream 216 to be fully condensed. Since this may not be possible to achieve, the first cooled compressed WMR stream 216 would not be fully condensed and would contain significant vapor concentration that may need to be liquefied separately.

A natural gas feed stream 202 (referred to the claims as a hydrocarbon feed stream) is cooled in a first precooling heat exchanger 260 to produce a first precooled natural gas stream 204 at a temperature below 20 degrees Celsius, preferably below about 10 degrees Celsius, and more preferably below about 0 degrees Celsius. As is known in the art, the natural gas feed stream 202 has preferably been pretreated to remove moisture and other impurities such as acid gases, mercury, and other contaminants. The first precooled natural gas stream 204 is cooled in a second precooling heat exchanger 262 to produce the second precooled natural gas stream 206 at a temperature below 10 degrees Celsius, preferably below about 0 degrees Celsius, and more preferably below about −30 degrees Celsius, depending on ambient temperature, natural gas feed composition and pressure. The second precooled natural gas stream 206 may be partially condensed. The second precooled natural gas stream 206 is sent to the MCHE (164 in FIG. 1) and liquefied to a temperature between about −150 degrees Celsius and about −70 degrees Celsius, preferably between about −145 degrees Celsius and about −100 degrees Celsius, and subsequently sub-cooled to produce an LNG stream (stream 108 in FIG. 1; referred to as a liquefied hydrocarbon stream in the claims) at a temperature between about −170 degrees Celsius and about −120 degrees Celsius, preferably between about −170 degrees Celsius and about −140 degrees Celsius. A compressed cooled CMR stream 244 (also referred to as a second refrigerant feed stream) is cooled in the first precooling heat exchanger 260 to produce a first precooled CMR stream 246. The compressed cooled CMR stream 244 may comprise more than 40% of components lighter than ethane, preferably more than 45% of components lighter than ethane, and, more preferably, more than 50% of components lighter than ethane The first precooled CMR stream 246 is cooled in a second precooling heat exchanger 262 to produce a second precooled CMR stream 248 (also referred to as precooled second refrigerant stream).

Although FIG. 2 shows two precooling heat exchangers and two pressure levels in the precooling circuit, any number of precooling heat exchangers and pressure levels may be utilized. The precooling heat exchangers are shown to be coil wound heat exchangers in FIG. 2. However, they may be plate and fin heat exchangers, shell and tube heat exchangers, or any other heat exchangers suitable for precooling natural gas.

The two precooling heat exchangers (260,262) of FIG. 2 may be two heat exchange sections within a single heat exchanger. Alternatively, the two precooling heat exchangers may be two heat exchangers, each with one or more heat exchange sections.

Optionally, a portion of the first precooled WMR stream 217 may be mixed with the first further cooled WMR stream 236 prior to expansion in the first WMR expansion device 226 to provide supplemental refrigeration to the first precooling heat exchanger 260 (shown with dashed line 217*a*).

Although FIG. 2 shows three compression stages, any number of compression stage may be performed. Further, compression stages 212A, 212B, and 212C may be part of a single compressor body, or be multiple separate compressors. Additionally, intermediate cooling heat exchangers may be provided between the stages. The WMR compressor 212 may be any type of compressor such as centrifugal, axial, positive displacement, or any other compressor type.

In the embodiment shown in FIG. 2, the warmest heat exchange section is the first precooling heat exchanger 260 and the coldest heat exchange section is the second precooling heat exchanger 262.

A benefit of the arrangement shown in FIG. 2 is that the WMR refrigerant stream is split into two portions; the first WMRL stream 275 with heavy hydrocarbons and the first WMRV stream 274 with lighter components. The first precooling heat exchanger 260 is cooled using the first WMRL stream 275 and the second precooling heat exchanger 262 is cooled using the first WMRV stream 274. Since the first precooling heat exchanger 260 cools to a warmer temperature than the second precooling heat exchanger 262, the heavier hydrocarbons in the WMR are required in the first precooling heat exchanger 260 while the lighter hydrocarbons in the WMR are required to provide deeper cooling in the second precooling heat exchanger 262. Therefore, the arrangement shown in FIG. 2 leads to improved process efficiency, and therefore lower required precooling power for the same amount of precooling duty. At fixed precooling power and feed flowrate, it enables colder precooling temperatures. Therefore, this arrangement also makes it possible to shift refrigeration load into the precooling system from the liquefaction system, thereby reducing the power requirement in the liquefaction system and reducing the size of the MCHE. Further, the WMR composition and pressures at various compression stages of the WMR compressor 212 may be optimized to result in an optimal vapor fraction in the cooled high-high pressure WMR stream 272, leading to further improvement in process efficiency. In a preferred embodiment, the three compression stages of WMR compressor 212 (212A, 212B, and 212C) are performed in a single compressor body, thereby minimizing capital cost.

Figure 3:
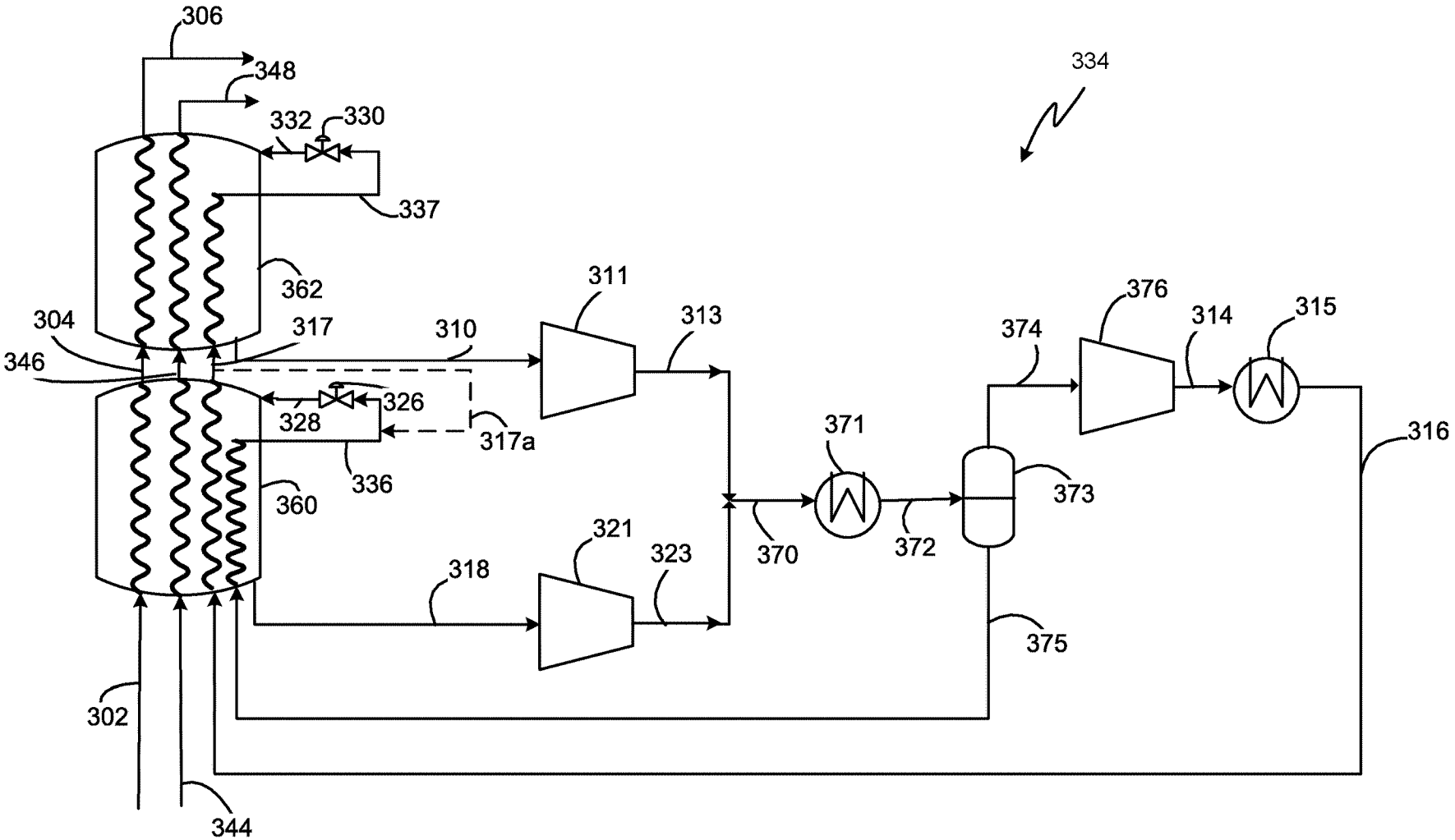
FIG. 3 is a schematic flow diagram of a precooling system of a DMR system in accordance with a second exemplary embodiment.

FIG. 3 shows a second embodiment. The low pressure WMR stream 310 is compressed in a low pressure WMR compressor 311 to produce a first high pressure WMR stream 313. A medium pressure WMR stream 318 is compressed in a medium pressure WMR compressor 321 to produce a second high pressure WMR stream 323. The first high pressure WMR stream 313 and the second high pressure WMR stream 323 are mixed to produce a high-high pressure WMR stream 370 at a pressure between 5 bara and 25 bara, and preferably between 10 bara and 20 bara. The high-high pressure WMR stream 370 is cooled in a high-high pressure WMR intercooler 371 to produce the cooled high-high pressure WMR stream 372. The high-high pressure WMR intercooler 371 may be an ambient cooler that cools against air or water and may comprise multiple heat exchangers. The cooled high-high pressure WMR stream 372 may have a vapor fraction between 0.3 and 0.9, preferably between 0.4 and 0.8, and more preferably between 0.45 and 0.6. The cooled high-high pressure WMR stream 372 is phase separated in a first WMR vapor-liquid separation device 373 to produce a first WMRV stream 374 and a first WMRL stream 375.

The first WMRL stream 375 contains less than 50% of ethane and lighter hydrocarbons, preferably less than 45% of ethane and lighter hydrocarbons, and more preferably less than 40% of ethane and lighter hydrocarbons. The first WMRV stream 374 contains more than 40% of ethane and lighter hydrocarbons, preferably more than 45% of ethane and lighter hydrocarbons, and more preferably more than 50% of ethane and lighter hydrocarbons. The first WMRL stream 375 is introduced into the first precooling heat exchanger to be cooled to produce a first further cooled WMR stream 336. The first further cooled WMR stream 336 is expanded in a first WMR expansion device 326 to produce a first expanded WMR stream 328 that provides refrigeration duty to the first precooling heat exchanger 360.

The first WMRV stream 374 is compressed in a high pressure WMR compressor 376 to produce a compressed WMR stream 314. The compressed WMR stream 314 is cooled and preferably condensed in a WMR aftercooler 315 to produce a first cooled compressed WMR stream 316 that is introduced into the first precooling heat exchanger 360 to be further cooled in a tube circuit to produce a first precooled WMR stream 317. The first precooled WMR stream 317 is introduced into the second precooling heat exchanger 362 to be further cooled to produce a second further cooled WMR stream 337. The second further cooled WMR stream 337 is expanded in a second WMR expansion device 330 to produce a second expanded WMR stream 332, which is introduced into the shell side of the second precooling heat exchanger 362 to provide refrigeration duty.

The low pressure WMR compressor 311, the medium pressure WMR compressor 321, and the high pressure WMR compressor 376 may comprise multiple compression stages with optional intercooling heat exchangers. The high pressure WMR compressor 376 may be part of the same compressor body as the low pressure WMR compressor 311 or the medium pressure WMR compressor 321. The compressors may be centrifugal, axial, positive displacement, or any other compressor type. Further, instead of cooling the high-high pressure WMR stream 370 in the high-high pressure WMR intercooler 371, the first high pressure WMR stream 313 and the second high pressure WMR stream 323 may be individually cooled in separate heat exchangers (not shown). The first WMR vapor-liquid separation device 373 may be a phase separator. In an alternate embodiment, the first WMR vapor-liquid separation device 373 may be a distillation column or a mixing column with a suitable cold stream introduced into the column.

Optionally, a portion of the first precooled WMR stream 317 may be mixed with the first further cooled WMR stream 336 prior to expansion in the first WMR expansion device 326 to provide supplemental refrigeration to the first precooling heat exchanger 360 (shown with dashed line 317*a*). A further embodiment is a variation of FIG. 3 with a three pressure precooling circuit. This embodiment involves a third compressor in addition to the low pressure WMR compressor 311 and the medium pressure WMR compressor 321.

In the embodiment shown in FIG. 3, the warmest heat exchange section is the first precooling heat exchanger 360 and the coldest heat exchange section is the second precooling heat exchanger 362.

Similar to FIG. 2, a benefit of the arrangement shown in FIG. 3 is that the WMR refrigerant stream is split into two portions; the first WMRL stream 375 with heavier hydrocarbons and the first WMRV stream 374 with lighter hydrocarbons. Since the first precooling heat exchanger 360 cools to a warmer temperature than the second precooling heat exchanger 362, the heavier hydrocarbons in the WMR are required in the first precooling heat exchanger 260 while the lighter hydrocarbons in the WMR are required to provide deeper cooling in the second precooling heat exchanger 262. Therefore, the arrangement shown in FIG. 3 leads to improved process efficiency and therefore lower required precooling power, as compared to FIG. 1 of the prior art. This arrangement also makes it possible to shift refrigeration load into the precooling system from the liquefaction system, thereby reducing the power requirement in the liquefaction system and reducing the size of the MCHE. Further, the WMR composition and compression pressures may be optimized to result in an optimal vapor fraction for the cooled high-high pressure WMR stream 372, leading to further improvement in process efficiency.

A drawback of the arrangement shown in FIG. 3 compared to that in FIG. 2 is that it requires at least two compressor bodies due to parallel compression of the WMR. However, it is beneficial in scenarios where multiple compression bodies are present. In the embodiment shown in FIG. 3, the low pressure WMR stream 310 and the medium pressure WMR stream 318 are compressed in parallel, which is beneficial in scenarios where compressor size limitations are a concern. The low pressure WMR compressor 311 and the medium pressure WMR compressor 321 may be designed independently and may have different number of impellers, pressure ratios, and other design characteristics.

Figure 4:
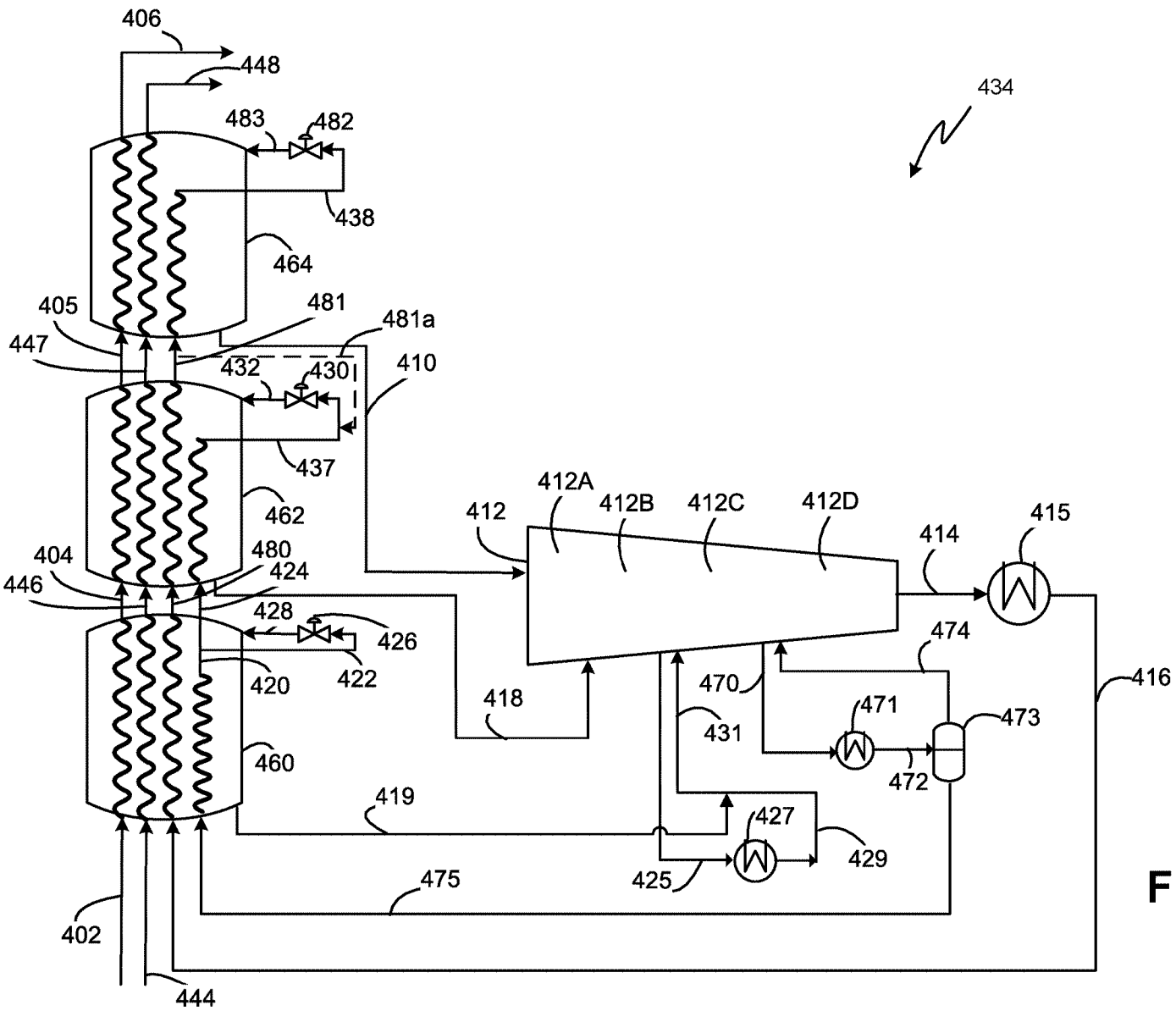
FIG. 4 is a schematic flow diagram of a precooling system of a DMR system in accordance with a third exemplary embodiment.

FIG. 4 shows a third embodiment for a three pressure precooling circuit. A low pressure WMR stream 410 is withdrawn from the warm end of shell side of a third precooling heat exchanger 464 and compressed in a first compression stage 412A of a WMR compressor 412. A medium pressure WMR stream 418 is withdrawn from the warm end of shell side of a second precooling heat exchanger 462 and introduced as a side-stream into the WMR compressor 412, where it mixes with the compressed stream (not shown) from the first compression stage 412A. The mixed stream (not shown) is compressed in a second compression stage 412B of the WMR compressor 412 to produce a first intermediate WMR stream 425.

The first intermediate WMR stream 425 is withdrawn from the WMR compressor 412, and cooled in a high pressure WMR intercooler 427, which may be ambient cooler, to produce a cooled first intermediate WMR stream 429. A high pressure WMR stream 419 is withdrawn from the warm end of shell side of a first precooling heat exchanger 460 and mixed with the cooled first intermediate WMR stream 429 to produce a mixed high pressure WMR stream 431. Any liquid present in the low pressure WMR stream 410, the medium pressure WMR stream 418, the high pressure WMR stream 419, and the cooled first intermediate WMR stream 429 may be removed in vapor-liquid separation devices (not shown). In an alternate embodiment, the high pressure WMR stream 419 may be introduced at any other suitable location in the WMR compression sequence, for instance as a side stream to the WMR compressor 412 or mixed with any other inlet stream to the WMR compressor 412.

The mixed high pressure WMR stream 431 is introduced into the WMR compressor 412 and compressed in a third WMR compression stage 412C of the WMR compressor 412 to produce a high-high pressure WMR stream 470. The high-high pressure WMR stream 470 may be at a pressure between 5 bara and 35 bara, and preferably between 15 bara and 25 bara. The high-high pressure WMR stream 470 is withdrawn from the WMR compressor 412, cooled and partially condensed in a high-high pressure WMR intercooler 471 to produce a cooled high-high pressure WMR stream 472. The high-high pressure WMR intercooler 471 may be an ambient cooler that uses air or water. The cooled high-high pressure WMR stream 472 may have a vapor fraction between 0.2 and 0.8, preferably between 0.3 and 0.7, and more preferably between 0.4 and 0.6. The cooled high-high pressure WMR stream 472 is phase separated in a first WMR vapor-liquid separation device 473 to produce a first WMRV stream 474 and a first WMRL stream 475.

The first WMRL stream 475 contains less than 50% of ethane and lighter hydrocarbons, preferably less than 45% of ethane and lighter hydrocarbons, and more preferably less than 40% of ethane and lighter hydrocarbons. The first WMRV stream 474 contains more than 40% of ethane and lighter hydrocarbons, preferably more than 45% of ethane and lighter hydrocarbons, and more preferably more than 50% of ethane and lighter hydrocarbons. The first WMRL stream 475 is introduced into the first precooling heat exchanger 460 to be cooled to produce a second cooled compressed WMR stream 420 that is split into two portions; a first portion 422 and a second portion 424. The first portion of the second cooled compressed WMR stream 422 is expanded in a first WMR expansion device 426 to produce a first expanded WMR stream 428 that provides refrigeration duty to the first precooling heat exchanger 460. The second portion of the second cooled compressed WMR stream 424 is further cooled in a tube circuit of the second precooling heat exchanger 462 to produce a second further cooled WMR stream 437. The second further cooled WMR stream 437 is expanded in a second WMR expansion device 430 to produce a second expanded WMR stream 432, which is introduced into the shell side of the second precooling heat exchanger 462 to provide refrigeration duty.

The first WMRV stream 474 is introduced into the WMR compressor 412 to be compressed in a fourth WMR compression stage 412D to produce a compressed WMR stream 414. The compressed WMR stream 414 is cooled and preferably condensed in a WMR aftercooler 415 to produce a first cooled compressed WMR stream 416, which is introduced into the first precooling heat exchanger 460 to be further cooled in a tube circuit to produce a second precooled WMR stream 480. The second precooled WMR stream 480 is introduced into the second precooling heat exchanger 462 to be further cooled to produce a third precooled WMR stream 481, which is introduced into the third precooling heat exchanger 464 to be further cooled to produce a third further cooled WMR stream 438. The third further cooled WMR stream 438 is expanded in a third WMR expansion device 482 to produce a third expanded WMR stream 483, which is introduced into the shell side of the third precooling heat exchanger 464 to provide refrigeration duty.

Optionally, a portion of the third precooled WMR stream 481 may be mixed with the second further cooled WMR stream 437 prior to expansion in the second WMR expansion device 430 (shown with dashed line 481*a*) to provide supplemental refrigeration to the second precooling heat exchanger 462.

The pre-treated feed stream 402 (also called a hydrocarbon feed stream) is cooled in the first precooling heat exchanger 460 to produce a first precooled natural gas stream 404. The first precooled natural gas stream 404 is cooled in the second precooling heat exchanger 462 to produce a third precooled natural gas stream 405, which is further cooled in the third precooling heat exchanger 464 to produce a second precooled natural gas stream 406. A compressed cooled CMR stream 444 is cooled in the first precooling heat exchanger 460 to produce a first precooled CMR stream 446. The first precooled CMR stream 446 is cooled in a second precooling heat exchanger 462 to produce a third precooled CMR stream 447, which is further cooled in a third precooling heat exchanger 464 to produce a second precooled CMR stream 448.

Although FIG. 4 shows four compression stages, any number of compression stages may be present. Further, the compression stages may be part of a single compressor body, or be multiple separate compressors with optional intercooling. The WMR compressor 412 may be any type of compressor such as centrifugal, axial, positive displacement, or any other compressor type.

In the embodiment shown in FIG. 4, the warmest heat exchange section is the first precooling heat exchanger 460 and the coldest heat exchange section is the third precooling heat exchanger 464.

The embodiment shown in FIG. 4 possesses all the benefits of the embodiment shown in FIG. 2. A further embodiment is a variation of FIG. 4 with only two precooling heat exchangers, such that the entire second cooled compressed WMR stream 420 is used to provide refrigeration to the first heat exchanger. This embodiment eliminates the need for an additional heat exchanger and is lower capital cost.

Figure 5:
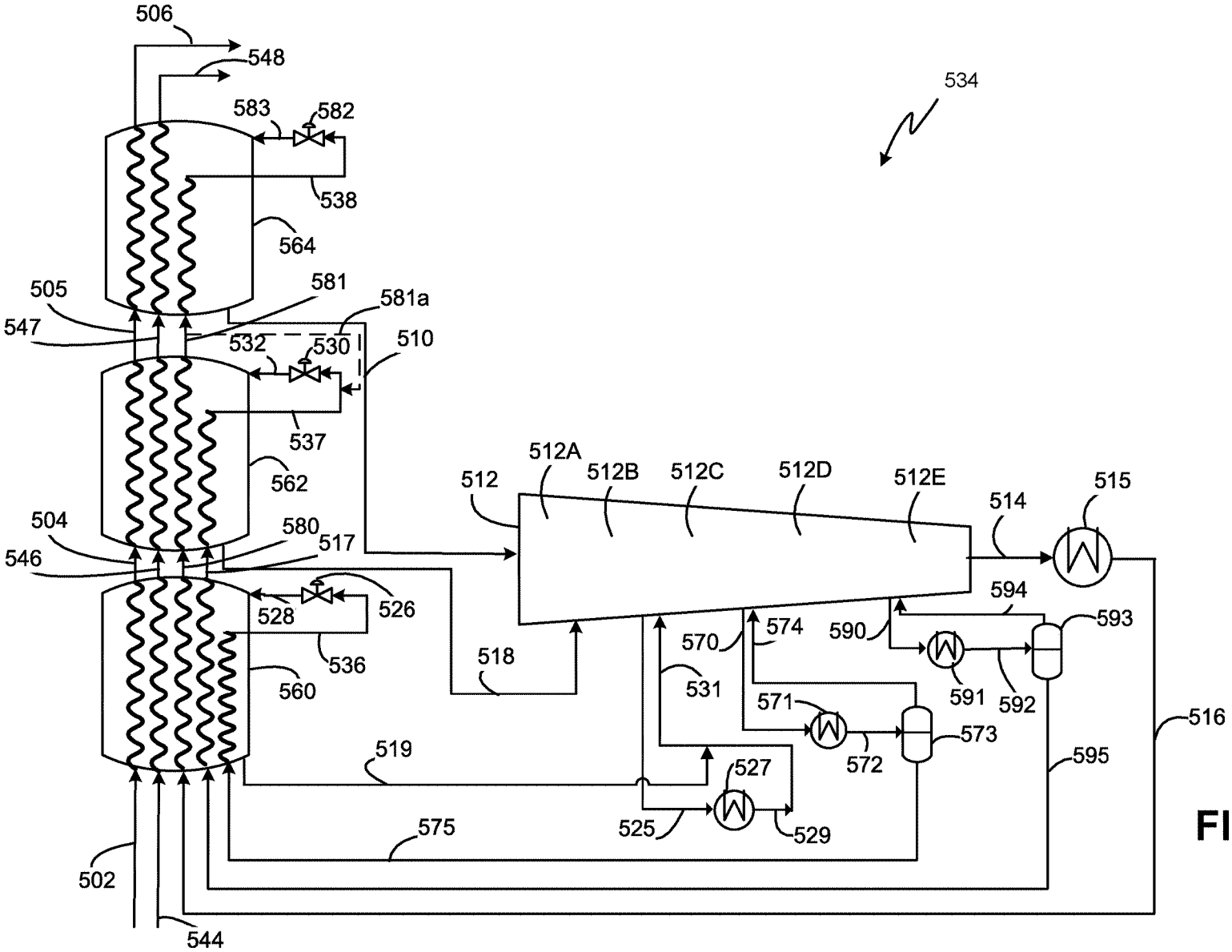
FIG. 5 is a schematic flow diagram of a precooling system of a DMR system in accordance with a fourth exemplary embodiment.

FIG. 5 shows a fourth embodiment and a variation of the embodiment shown in FIG. 4 with three precooling heat exchangers. A low pressure WMR stream 510 is withdrawn from the warm end of the shell side of a third precooling heat exchanger 564 and compressed in a first compression stage 512A of a WMR compressor 512. A medium pressure WMR stream 518 is withdrawn from the warm end of shell side of a second precooling heat exchanger 562 and introduced as a side-stream into the WMR compressor 512, where it mixes with the compressed stream (not shown) from the first compression stage 512A. The mixed stream (not shown) is compressed in a second compression stage 512B of the WMR compressor 512 to produce a first intermediate WMR stream 525. The first intermediate WMR stream 525 is cooled in a high pressure WMR intercooler 527, which may be ambient cooler, to produce a cooled first intermediate WMR stream 529.

Any liquid present in the low pressure WMR stream 510, the medium pressure WMR stream 518, and the high pressure WMR stream 519 may be removed in vapor-liquid separation devices (not shown).

A high pressure WMR stream 519 is withdrawn from the warm end of the shell side of a first precooling heat exchanger 560 and mixed with the cooled first intermediate WMR stream 529 to produce a mixed medium pressure WMR stream 531.

The mixed medium pressure WMR stream 531 is introduced into the WMR compressor 512 to be compressed in a third WMR compression stage 512C of the WMR compressor 512 to produce a high-high pressure WMR stream 570. The high-high pressure WMR stream 570 may be at a pressure between 5 bara and 35 bara, and preferably between 10 bara and 25 bara. The high-high pressure WMR stream 570 is withdrawn from the WMR compressor 512, and cooled and partially condensed in a high-high pressure WMR intercooler 571 to produce a cooled high-high pressure WMR stream 572. The high-high pressure WMR intercooler 571 may be an ambient cooler that uses air or water. The cooled high-high pressure WMR stream 572 may have a vapor fraction between 0.2 and 0.8, preferably between 0.3 and 0.7, and more preferably between 0.4 and 0.6. The cooled high-high pressure WMR stream 572 is phase separated in a first WMR vapor-liquid separation device 573 to produce a first WMRV stream 574 and a first WMRL stream 575.

The first WMRL stream 575 contains less than 50% of ethane and lighter hydrocarbons, preferably less than 45% of ethane and lighter hydrocarbons, and more preferably less than 40% of ethane and lighter hydrocarbons. The first WMRV stream 574 contains more than 40% of ethane and lighter hydrocarbons, preferably more than 45% of ethane and lighter hydrocarbons, and more preferably more than 50% of ethane and lighter hydrocarbons. The first WMRL stream 575 is introduced into the first precooling heat exchanger 560 to be cooled in a tube circuit to produce a first further cooled WMR stream 536. The first further cooled WMR stream 536 is expanded in a first WMR expansion device 526 to produce a first expanded WMR stream 528. The first expanded WMR stream 528 provides refrigeration duty for the first precooling heat exchanger 560.

The first WMRV stream 574 is introduced into the WMR compressor 512 to be compressed in a fourth WMR compression stage 512D to produce a second intermediate WMR stream 590 at a pressure between 10 bara and 50 bara, and preferably between 15 bara and 45 bara. The second intermediate WMR stream 590 is withdrawn from the WMR compressor 512, and cooled and partially condensed in a first WMRV intercooler 591 to produce a cooled second intermediate WMR stream 592. The first WMRV intercooler 591 may be an ambient cooler that cools against air or water. The cooled second intermediate WMR stream 592 may have a vapor fraction between 0.2 and 0.8, preferably between 0.3 and 0.7, and more preferably between 0.4 and 0.6. The cooled second intermediate WMR stream 592 is phase separated in a second WMR vapor-liquid separation device 593 to produce a second WMRV stream 594 and a second WMRL stream 595.

The second WMRL stream 595 is cooled in a tube of circuit of the first precooling heat exchanger 560 to produce a first precooled WMR stream 517. The first precooled WMR stream 517 is further cooled in a tube circuit of the second precooling heat exchanger 562 to produce a second further cooled WMR stream 537. The second further cooled WMR stream 537 is expanded in a second WMR expansion device 530 to produce a second expanded WMR stream 532 that provides refrigeration duty to the second precooling heat exchanger 562. In an alternate embodiment, a portion of the first precooled WMR stream 517 may be mixed with the first further cooled WMR stream 536 prior to expansion in the first WMR expansion device 526 in order to provide supplemental refrigeration to the first precooling heat exchanger 560.

The second WMRV stream 594 is introduced into the WMR compressor 512 to be compressed in a fifth WMR compression stage 512E to produce a compressed WMR stream 514. The compressed WMR stream 514 is cooled and preferably condensed in a WMR aftercooler 515 to produce a first cooled compressed WMR stream 516, which is introduced into the first precooling heat exchanger 560 to be further cooled in a tube circuit to produce a second precooled WMR stream 580. The second precooled WMR stream 580 is introduced into the second precooling heat exchanger 562 to be further cooled to produce a third precooled WMR stream 581, which is introduced into the third precooling heat exchanger 564 to be further cooled to produce a third further cooled WMR stream 538. The third further cooled WMR stream 538 is expanded in a third WMR expansion device 582 to produce a third expanded WMR stream 583, which is introduced into the shell side of the third precooling heat exchanger 564 to provide refrigeration duty.

In the embodiment shown in FIG. 5, the warmest heat exchange section is the first precooling heat exchanger 460 and the coldest heat exchange section is the third precooling heat exchanger 464.

FIG. 5 possesses all the benefits of the embodiment described in FIG. 2. It involves a third precooling heat exchanger and additional compression stages, therefore higher capital cost than FIG. 2. However, FIG. 5 involves three different WMR compositions, one for each of the three precooling heat exchangers. Therefore, the embodiment of FIG. 5 results in improved process efficiency at increased capital cost.

Optionally, a portion of the second precooled WMR stream 580 may be mixed with the first further cooled WMR stream 536 prior to expansion in the first WMR expansion device 526 to provide supplemental refrigeration to the first precooling heat exchanger 560 (shown with dashed line 581*a*). Alternatively or additionally, a portion of the third precooled WMR stream 581 may be mixed with the second further cooled WMR stream 537 prior to expansion in the second WMR expansion device 530 in order to provide supplemental refrigeration duty to the second precooling heat exchanger 562.

The pre-treated feed stream 502 is cooled in the first precooling heat exchanger 560 to produce a first precooled natural gas stream 504. The first precooled natural gas stream 504 is cooled in the second precooling heat exchanger 562 to produce a third precooled natural gas stream 505, which is further cooled in the third precooling heat exchanger 564 to produce a second precooled natural gas stream 506. A compressed cooled CMR stream 544 is cooled in the first precooling heat exchanger 560 to produce a first precooled CMR stream 546. The first precooled CMR stream 546 is cooled in a second precooling heat exchanger 562 to produce a third precooled CMR stream 547, which is further cooled in a third precooling heat exchanger 564 to produce a second precooled CMR stream 548.

In all the embodiments (FIG. 2-FIG. 5 and variations thereof), any liquid present in warm shell side streams from the precooling heat exchangers may be sent to vapor-liquid phase separators to remove any liquid prior to compressing the vapor in the WMR compressor. In alternate embodiments, if significant amounts of liquid are present in the warm shell side streams from the precooling heat exchangers, the liquid fraction may be pumped to be mixed with the discharge of any compression stage or mixed with one or more liquid streams to be introduced into a precooling heat exchanger, or introduced in a separate circuit in a precooling heat exchanger. For instance, in FIG. 5, any liquid present in the high pressure WMR stream 519, the low pressure WMR stream 510, or the medium pressure WMR stream 518 may be pumped to be mixed with the compressed WMR stream 514, or the first WMRL stream 575.

In all the embodiments, any aftercooler or intercooler can comprise multiple individual heat exchangers such as a desuperheater and a condenser.

The temperature of the second precooled natural gas stream (206, 306, 406, 506) may be defined as the "precooling temperature". The precooling temperature is the temperature at which the feed natural gas stream exits the precooling system and enters the liquefaction system. The precooling temperature has an impact on the power requirement for precooling and liquefying the feed natural gas. The power requirement for the total system is defined as the sum of the power requirement for the precooling system and the power requirement for the liquefaction system. The ratio of the power requirement for the precooling system to the power requirement for the total system is defined as the "power split".

For the embodiments described in FIG. 2-FIG. 5, the power split is between 0.2 and 0.7, preferably between 0.3 and 0.6, and more preferably about 0.5.

As the power split increases, the power requirement for liquefaction system decreases and the precooling temperature decreases. In other words, the refrigeration load is shifted from the liquefaction system into the precooling system. This is beneficial for systems where the MCHE size and/or liquefaction power availability are controlling. As the power split reduces, the power requirement for liquefaction system increases and the precooling temperature increases. In other words, the refrigeration load is shifted from the precooling system into the liquefaction system. This arrangement is beneficial for systems wherein the precooling exchanger size, number, or precooling power availability is limiting. The power split is typically determined by the type, quantity, and capacity of the drivers selected for a particular natural gas liquefaction facility. For instance, if an even number of drivers is available, it may be preferable to operate at a power split of about 0.5, shifting the power load into the precooling heat exchanger, and lowering the precooling temperature. If an odd number of drivers is available, the power split may be between 0.3 and 0.5, shifting refrigeration load into the liquefaction system, and raising the precooling temperature.

A key benefit of all the embodiments is that it allows for optimization of the power split, number of the precooling heat exchangers, compression stages, pressure levels, and the precooling temperature based on various factors such as the number, quantity, type, and capacity of drivers available, number of heat exchangers, heat exchanger design criteria, compressor limitations, and other project-specific requirements.

For all the embodiments described, any number of pressure levels may be present in the precooling and liquefaction systems. Further, the refrigeration systems may be open or closed loop.

Example 1

The following is an example of the operation of an exemplary embodiment. The example process and data are based on simulations of a DMR process with a two pressure precooling circuit and a single pressure liquefaction circuit in an LNG plant that produces about 5.5 million metric tons per annum of LNG and specifically refers to the embodiment shown in FIG. 2. In order to simplify the description of this example, elements and reference numerals described with respect to the embodiment shown in FIG. 2 will be used.

The natural gas feed stream 202 at 76 bara (1102 psia) and 20 degrees Celsius (68 degrees Fahrenheit) is cooled in the first precooling heat exchanger 260 to produce a first precooled natural gas stream 204 at −18 degrees Celsius (0.5 degrees Fahrenheit), which is cooled in the second precooling heat exchanger 262 to produce the second precooled natural gas stream 206 at −53 degrees Celsius (−64 degrees Fahrenheit). The compressed cooled CMR stream 244 at 62 bara (893 psia) and 25 degrees Celsius (77 degrees Fahrenheit) is cooled in the first precooling heat exchanger 260 to produce the first precooled CMR stream 246 at −18 degrees Celsius (0.5 degrees Fahrenheit), which is in the second precooling heat exchanger 262 to produce a second precooled CMR stream 248 at −52 degrees Celsius (−61 degrees Fahrenheit).

The low pressure WMR stream 210 (also referred to as a low pressure first refrigerant stream) at 3 bara (45 psia), −20 degrees Celsius (−5 degrees Fahrenheit), and 11,732 kgmole/hr (25,865 lbmole/hr) is withdrawn from the warm end of shell side of a second precooling heat exchanger 262 and compressed in a first compression stage 212A of a WMR compressor 212. The medium pressure WMR stream 218 (also referred to as a medium pressure first refrigerant stream) at 5 bara (74 psia), 22 degrees Celsius (71 degrees Fahrenheit), and 13,125 kgmole/hr (28936 lbmole/hr) is withdrawn from the warm end of shell side of a first precooling heat exchanger 260 and introduced as a side-stream into the WMR compressor 212, where it mixes with the compressed stream (not shown) from the first compression stage 212A. The mixed stream (not shown) is compressed in a second WMR compression stage 212B of the WMR compressor 212 to produce the high-high pressure WMR stream 270 (also referred to as a high-high pressure first refrigerant stream) at 18 bara (264 psia) and 79 degrees Celsius (175 degrees Fahrenheit).

The high-high pressure WMR stream 270 is withdrawn from the WMR compressor 212, and cooled and partially condensed in the high-high pressure WMR intercooler 271 to produce a cooled high-high pressure WMR stream 272 at 17 bara (250 psia), 25 degrees Celsius (77 degrees Fahrenheit), 24,857 kgmole/hr (54,801 lbmole/hr), and vapor fraction of 0.47. The cooled high-high pressure WMR stream 272 is phase separated in a first WMR vapor-liquid separation device 273 to produce a first WMRV stream 274 and a first WMRL stream 275. The first WMRL stream 275 contains 31% of ethane and lighter hydrocarbons while the first WMRV stream 274 contains 59% of ethane and lighter hydrocarbons.

The first WMRL stream 275 is introduced into the first precooling heat exchanger 260 to be cooled in a tube circuit to produce a first further cooled WMR stream 236 at −18 degrees Celsius (0 degrees Fahrenheit) that is expanded in a first WMR expansion device 226 to produce a first expanded WMR stream 228 at 6 bara (81 psia) and −21 degrees Celsius (−5 degrees Fahrenheit) that provides refrigeration duty to the first precooling heat exchanger 260.

The first WMRV stream 274 is introduced into the WMR compressor 212 to be compressed in a third WMR compression stage 212C to produce a compressed WMR stream 214 at 29 bara (423 psia) and 56 degrees Celsius (134 degrees Fahrenheit). The compressed WMR stream 214 is cooled and preferably condensed in a WMR aftercooler 215 to produce a first cooled compressed WMR stream 216 at 25 degrees Celsius (77 degrees Fahrenheit), which is introduced into the first precooling heat exchanger 260 to be further cooled in a tube circuit to produce a first precooled WMR stream 217 at −18 degrees Celsius (0 degrees Fahrenheit). The first precooled WMR stream 217 is introduced into the second precooling heat exchanger 262 to be further cooled in a tube circuit to produce a second further cooled WMR stream 237 at −53 degrees Celsius (−63 degrees Fahrenheit). The second further cooled WMR stream 237 is expanded in a second WMR expansion device 230 to produce a second expanded WMR stream 232 at 3 bara (47 psia) and −57 degrees Celsius (−70 degrees Fahrenheit), which is introduced into the shell side of the second precooling heat exchanger 262 to provide refrigeration duty.

In this example, the power split is 0.44 and a total of four gas turbine drivers were utilized, each driver with a capacity of about 40 MW. This embodiment has a process efficiency of about 3.5% higher than that corresponding to FIG. 1 and a precooling temperature about 9 degrees Celsius colder than that for FIG. 1. Therefore, this example demonstrates that the embodiments described herein provide an efficient method and system to improve the efficiency, at low capital cost.

The invention claimed is:

1. A method of cooling a hydrocarbon feed stream comprising a hydrocarbon fluid and a second refrigerant feed stream comprising a second refrigerant by indirect heat exchange with a first refrigerant in each of a plurality of heat exchange sections, wherein the method comprises:

(a) introducing the hydrocarbon feed stream and the second refrigerant feed stream into a first heat exchange section of the plurality of heat exchange sections;

(b) cooling the hydrocarbon feed stream and the second refrigerant feed stream in each of the plurality of heat exchange sections to produce a precooled hydrocarbon stream and a precooled second refrigerant stream;

(c) further cooling and liquefying the precooled hydrocarbon stream in a main heat exchanger against the second refrigerant to produce a liquefied hydrocarbon stream;

(d) withdrawing a low pressure first refrigerant stream from a second heat exchange section of the plurality of heat exchange sections and compressing the low pressure first refrigerant stream in at least one compression stage of a compression system;

(e) withdrawing a medium pressure first refrigerant stream from the first heat exchange section of the plurality of heat exchange sections and introducing the medium pressure first refrigerant stream into the compression system at a pressure that is greater than the low pressure first refrigerant stream and less than a high-high pressure first refrigerant stream, the first heat exchange section being warmer than the second heat exchange section;

(f) combining the low pressure first refrigerant stream and the medium pressure first refrigerant stream to produce a combined first refrigerant stream after steps (d) and (e) have been performed;

(g) withdrawing from the compression system, the high-high pressure first refrigerant stream;

(h) cooling and at least partially condensing the high-high pressure first refrigerant stream in at least one cooling unit to produce a cooled high-high pressure first refrigerant stream;

(i) introducing the cooled high-high pressure first refrigerant stream into a first vapor-liquid separation device to produce a first vapor refrigerant stream and a first liquid refrigerant stream;

(j) introducing the first liquid refrigerant stream into the first heat exchange section of the plurality of heat exchange sections;

(k) cooling the first liquid refrigerant stream in the first heat exchange section of the plurality of heat exchange sections to produce a first cooled liquid refrigerant stream;

(l) expanding at least a portion of the first cooled liquid refrigerant stream to produce a first expanded refrigerant stream;

(m) introducing the first expanded refrigerant stream in the first heat exchange section to provide refrigeration duty to provide a first portion of the cooling of step (b);

(n) compressing at least a portion of the first vapor refrigerant stream of step (i) in at least one compression stage to produce a compressed first refrigerant stream;

(o) cooling and condensing the compressed first refrigerant stream in at least one cooling unit to produce a condensed first refrigerant stream, the at least one cooling unit being downstream from and in fluid flow communication with the at least one compression stage of step (n);

(p) introducing the condensed first refrigerant stream into the first heat exchange section of the plurality of heat exchange sections;

(q) cooling the condensed first refrigerant stream in the first heat exchange section and the second heat exchange section to produce a first cooled condensed refrigerant stream;

(r) expanding the first cooled condensed refrigerant stream to produce a second expanded refrigerant stream; and (s) introducing the second expanded refrigerant stream into the second heat exchange section to provide refrigeration duty to provide a second portion of the cooling of step (b).

2. The method of claim 1, wherein step (n) further comprises compressing the first vapor refrigerant stream of step (i) in at least one compression stage to form the compressed first refrigerant stream of step (o).

3. The method of claim 1, further comprising compressing the combined first refrigerant stream of step (f) in at least one compression stage of the compression system prior to performing step (g).

4. The method of claim 1, further comprising:

(t) withdrawing a first intermediate refrigerant stream from the compression system prior to step (g); and (u) cooling the first intermediate refrigerant stream in at least one cooling unit to produce a cooled first intermediate refrigerant stream and introducing the cooled first intermediate refrigerant stream into the compression system prior to step (g).

5. The method of claim 1, further comprising:

(t) withdrawing a high pressure first refrigerant stream from the first heat exchange section of the plurality of heat exchange sections; and (u) introducing the high pressure first refrigerant stream into the compression system prior to step (g).

6. The method of claim 5, further comprising:

(v) withdrawing a high pressure first refrigerant stream from the first heat exchange section of the plurality of heat exchange sections; and (w) combining the high pressure first refrigerant stream with the cooled first intermediate refrigerant stream to form a combined first intermediate refrigerant stream and introducing the combined first intermediate refrigerant stream into the compression system prior to step (g).

7. The method of claim 4 further comprising:

(t) withdrawing a second intermediate refrigerant stream from the compression system; and (u) cooling the second intermediate refrigerant stream in at least one cooling unit to produce a cooled second intermediate refrigerant stream.

8. The method of claim 7, further comprising:

(v) introducing the cooled second intermediate refrigerant stream into a second vapor-liquid separation device to produce a second vapor refrigerant stream and a second liquid refrigerant stream;

(w) introducing the second liquid refrigerant stream into the first heat exchange section of the plurality of heat exchange sections; and (x) compressing the second vapor refrigerant stream in at least one compression stage of the compression system prior to producing the compressed first refrigerant stream of stream (o).

9. The method of claim 1, wherein step (q) further comprises cooling the condensed first refrigerant stream in the first heat exchange section prior to cooling in the first heat exchange section.

10. The method of claim 1, wherein the low pressure first refrigerant stream of step (d), the combined first refrigerant stream of step (f), and the first vapor refrigerant stream of step (i) are compressed in multiple compression stages of a single compressor.

11. An apparatus for cooling a hydrocarbon feed stream comprising:

a plurality of heat exchange sections, the plurality of heat exchange sections comprising a first heat exchange section, a second heat exchange, and a third heat exchange section, the first heat exchange section being warmer than both the second and third heat exchange sections and the third heat exchange section being warmer than the second heat exchange section;

a first hydrocarbon circuit that extends through each of the plurality of heat exchange sections, the first hydrocarbon circuit being downstream from and in fluid flow communication with a supply of a hydrocarbon fluid;

a second refrigerant circuit that extends through each of the plurality of heat exchange sections, the second refrigerant circuit containing a second refrigerant;

a first precooling refrigerant circuit that extends through the first heat exchange section, the first precooling refrigerant circuit containing a first portion of a first refrigerant;

a second precooling refrigerant circuit that extends through the first heat exchange section and the second heat exchange section, the second precooling refrigerant circuit containing a second portion of the first refrigerant;

a first precooling refrigerant circuit inlet located at an upstream end of the first precooling refrigerant circuit, a first pressure letdown device located at a downstream end of the first precooling refrigerant circuit, and a first expanded refrigerant conduit downstream from and in fluid flow communication with the first pressure letdown device and a first cold circuit of the first heat exchange section;

a second precooling refrigerant circuit inlet located at an upstream end of the second precooling refrigerant circuit, a second pressure letdown device located at a downstream end of the second precooling refrigerant circuit, and a second expanded refrigerant conduit downstream from and in fluid flow communication with the second pressure letdown device and a second cold circuit of the second heat exchange section;

a compression system comprising:

a low pressure first refrigerant conduit in fluid flow communication with a first compression stage and a warm end of the second heat exchange section;

a medium pressure first refrigerant conduit in fluid flow communication with a second compression stage and a warm end of one selected from the group of: the first heat exchange section and the third heat exchange section;

a first aftercooler downstream from the second compression stage;

a first vapor-liquid separation device having a first inlet in fluid flow communication with, and downstream from, the first aftercooler, a first vapor outlet located in an upper half of the first vapor-liquid separation device, a first liquid outlet located in a lower half of the first vapor-liquid separation device, the first liquid outlet being upstream from and in fluid flow communication with the first precooling refrigerant circuit inlet;

a third compression stage downstream from the first vapor outlet;

and a second aftercooler downstream from the third compression stage;

wherein the first heat exchange section is operationally configured to partially precool the hydrocarbon fluid flowing through the first hydrocarbon circuit, the second refrigerant flowing through the second refrigerant circuit, the first portion of the first refrigerant flowing through the first precooling first refrigerant circuit, and the second portion of the first refrigerant flowing through the second precooling refrigerant circuit against the first portion of the first refrigerant flowing through the first cold circuit of the first heat exchange section; and wherein the second heat exchange section is operationally configured to precool the hydrocarbon fluid flowing through the first hydrocarbon circuit to produce a precooled hydrocarbon stream, to precool the second refrigerant flowing through the second refrigerant circuit, and to pre-cool the first refrigerant flowing through the second precooling refrigerant circuit against the first refrigerant flowing through the first cold circuit of the second heat exchange section.

12. The apparatus of claim 11, further comprising:

a main heat exchanger having a second hydrocarbon circuit that is downstream from and in fluid flow communication with the first hydrocarbon circuit of the plurality of heat exchange sections, the main heat exchanger being operationally configured to at least partially liquefy the pre-cooled hydrocarbon stream by indirect heat exchange against the second refrigerant.

13. The apparatus of claim 11, the compression system further comprising a first intercooler downstream from the second compression stage and a cooled first intermediate refrigerant conduit downstream from and in fluid flow communication with the first intercooler.

14. The apparatus of claim 13, further comprising a high pressure first refrigerant conduit in fluid flow communication with a warm end of the first heat exchange section and the cooled first intermediate refrigerant conduit.

15. The apparatus of claim 11, further comprising:

a third aftercooler downstream from the first vapor-liquid separation device;

and a second vapor-liquid separation device having a third inlet in fluid flow communication with and downstream from the third aftercooler, a second vapor outlet located in an upper half of the second vapor-liquid separation device, a second liquid outlet located in a lower half of the second vapor-liquid separation device.

16. The apparatus of claim 11, wherein the second portion of the first refrigerant contained in the second precooling refrigerant circuit has a higher concentration of ethane and lighter hydrocarbons than the first portion of the first refrigerant contained in the first precooling refrigerant circuit.

17. The apparatus of claim 11, further comprising a third precooling refrigerant circuit that extends through at least the first heat exchange section and the third heat exchange section, the third precooling refrigerant circuit containing a third portion of the first refrigerant.

18. The apparatus of claim 11, wherein the first heat exchange section is the first heat exchange section of the plurality of heat exchange sections.

19. The apparatus of claim 11, wherein the second precooling refrigerant circuit extends through the first heat exchange section, the third heat exchange section, and the second heat exchange section.

20. The apparatus of claim 11, wherein the plurality of heat exchange sections consists of the first and second heat exchange sections and the medium pressure first refrigerant conduit is in fluid flow communication with the second compression stage and the warm end of the first heat exchange section.

21. A method of cooling a hydrocarbon feed stream comprising a hydrocarbon fluid and a second refrigerant feed stream comprising a second refrigerant by indirect heat exchange with a first refrigerant in each of a plurality of heat exchange sections, wherein the method comprises:

(a) introducing the hydrocarbon feed stream and the second refrigerant feed stream into a first heat exchange section of the plurality of heat exchange sections;

(b) cooling the hydrocarbon feed stream and the second refrigerant feed stream in each of the plurality of heat exchange sections to produce a precooled hydrocarbon stream and a precooled second refrigerant stream;

(c) further cooling and liquefying the precooled hydrocarbon stream in a main heat exchanger against the second refrigerant to produce a liquefied hydrocarbon stream;

(d) withdrawing a medium pressure first refrigerant stream from a second heat exchange section of the plurality of heat exchange sections and introducing the medium pressure first refrigerant stream into at least one compression stage of a compression system at a pressure that is greater than the low pressure first refrigerant stream and less than a high-high pressure first refrigerant stream, the first heat exchange section being warmer than the second heat exchange section, the second heat exchange section being warmer than the third heat exchange section;

(e) withdrawing a low pressure first refrigerant stream from a third heat exchange section of the plurality of heat exchange sections and compressing the low pressure first refrigerant stream in at least one compression stage of the compression system;

(f) combining the low pressure first refrigerant stream and the medium pressure first refrigerant stream to produce a combined first refrigerant stream after steps (d) and (e) have been performed;

(g) withdrawing from the compression system, the high-high pressure first refrigerant stream;

(h) cooling and at least partially condensing the high-high pressure first refrigerant stream in at least one cooling unit to produce a cooled high-high pressure first refrigerant stream;

(i) introducing the cooled high-high pressure first refrigerant stream into a first vapor-liquid separation device to produce a first vapor refrigerant stream and a first liquid refrigerant stream;

(j) introducing the first liquid refrigerant stream into the first heat exchange section of the plurality of heat exchange sections;

(k) cooling the first liquid refrigerant stream in the first heat exchange section of the plurality of heat exchange sections to produce a first cooled liquid refrigerant stream;

(l) expanding at least a portion of the first cooled liquid refrigerant stream to produce a first expanded refrigerant stream;

(m) introducing the first expanded refrigerant stream into the first heat exchange section to provide refrigeration duty to provide a first portion of the cooling of step (b);

(n) compressing at least a portion of the first vapor refrigerant stream of step (i) in at least one compression stage to produce a compressed first refrigerant stream;

(o) cooling and condensing the compressed first refrigerant stream in at least one cooling unit to produce a condensed first refrigerant stream, the at least one cooling unit being downstream from and in fluid flow communication with the at least one compression stage of step (n);

(p) introducing the condensed first refrigerant stream into the first heat exchange section of the plurality of heat exchange sections;

(q) cooling the condensed first refrigerant stream in the first, second and third heat exchange sections to produce a first cooled condensed refrigerant stream;

(r) expanding the first cooled condensed refrigerant stream to produce a second expanded refrigerant stream; and (s) introducing the second expanded refrigerant stream into the third heat exchange section to provide refrigeration duty to provide a second portion of the cooling of step (b).

* * * * *